United States Patent [19]

Campbell, Jr.

[11] Patent Number: 4,838,785

[45] Date of Patent: Jun. 13, 1989

[54] WALKING BEAM FURNACE INSULATION

[75] Inventor: Frank Campbell, Jr., Houston, Tex.

[73] Assignee: Cameron Forge Company, Houston, Tex.

[21] Appl. No.: 214,940

[22] Filed: Jul. 5, 1988

[51] Int. Cl.[4] ..... F27B 9/00

[52] U.S. Cl. ..... 432/121; 432/122; 432/234

[58] Field of Search ..... 432/121, 122, 123, 239, 432/243, 245

[56] References Cited

U.S. PATENT DOCUMENTS

| | | | |
|---|---|---|---|
| 1,638,005 | 8/1927 | Le Rouge | 62/22 |
| 1,880,981 | 10/1932 | Pollitzer et al. | 62/31 |
| 2,545,462 | 3/1951 | Haynes | 62/175.5 |
| 2,547,177 | 4/1951 | Simpson | 62/175.5 |
| 2,592,236 | 4/1952 | Bloom | 432/121 |
| 2,700,282 | 1/1955 | Roberts | 62/175.5 |
| 2,728,205 | 12/1955 | Becker et al. | 62/122 |
| 2,762,208 | 9/1956 | Dennis | 62/122 |
| 3,471,134 | 10/1969 | Cone | 432/121 |
| 3,544,094 | 12/1970 | Knaok | 432/121 |
| 3,588,059 | 6/1971 | Weineck | 432/234 |
| 3,729,943 | 5/1973 | Petit | 62/22 |
| 3,820,946 | 6/1974 | Miyoshi et al. | 432/121 |
| 3,887,064 | 6/1975 | Brockmann | 432/122 |
| 4,057,407 | 11/1977 | Bigi | 62/22 |
| 4,137,056 | 1/1979 | Golovko | 62/13 |
| 4,256,454 | 3/1981 | Wiersona | 432/122 |
| 4,391,587 | 7/1983 | Murakami et al. | 432/122 |
| 4,433,990 | 2/1984 | Olszewski | 62/22 |
| 4,533,375 | 8/1985 | Erickson | 62/22 |
| 4,741,695 | 5/1988 | Ushijima | 432/122 |

*Primary Examiner*—Henry C. Yuen

*Attorney, Agent, or Firm*—Vinson & Elkins

[57] ABSTRACT

An improved walking beam furnace insulation in which the leg openings through the furnace floor are provided with insulation to limit the heat losses therethrough and such insulation includes an insulating cap secured to the leg within the furnace and positioned to engage the insulating material surrounding the leg openings in the furnace floor during a substantial portion of the time. Additionally a pipe is secured to said leg to circulate water therethrough.

6 Claims, 4 Drawing Sheets

WALKING BEAM FURNACE INSULATION

BACKGROUND

Metallurgical furnaces include walking beam type furnaces and pusher type furnaces. The present invention relates to an improvement in the insulation for a walking beam type of furnace.

Walking beam furnaces include support beams which extend horizontally in the heated furnace area and beams that are supported on legs extending upward through the lower surface of the furnace and such legs are actuated so that the legs are raised so that their beams engage the work pieces within the furnace and move them progressively along the furnace a preselected distance in the direction toward the outlet. The movement of the legs is preferably timed so that the legs are in motion only a small portion of the time and when not in motion the legs are positioned in their retracted position so that their first action is to extend upwardly in the furnace to engage the work pieces.

U.S. Pat. Nos. 3,544,094, 3,471,134, 4,330,262 and 4,585,411 disclose walking beam furnaces which have been known prior to the present invention. U.S. Pat. No. 2,592,236 discloses a walking beam furnace in which the opening in the lower furnace wall through which the legs move is provided with plates through which the legs extends and which are mounted in any suitable fashion so that they are slidable along the bottom of the furnace to cover the openings in any adjusted position of the legs. This is stated to be an attempt to control the large volumes of air which are drawn into the furnace through these openings. The disadvantage of such plates is that in metallurgical furnaces such plates will only last a very short time and then will burn through to allow the air flow through the openings and possibly due to warping cause resistance to the movement of the legs.

SUMMARY

The improved walking beam furnace insulation of the present invention includes an insulated cover and water circulation piping secured to the portion of each of the legs within the furnace and such covers have a size preselected so that they cover the leg openings through the lower surface of the furnace. The insulated covers are oblong in shape to conform to the shape of the openings through which the legs extend and to be able to engage and close such openings when the legs are in the lower or retracted positions. The water pipe is shaped to conform to the inside of the insulated covers and extends through the furnace opening with the legs for suitable connection to a water system beneath the furnace.

An object of the present invention is to provide an improved insulation for a walking beam furnace which functions to limit heat losses through the leg openings in the lower wall or floor of the furnace.

Another object is to provide an improved insulation for a walking beam furnace which recovers some of the heat lost through the leg openings in the lower wall or floor of the furnace.

Still a further object is to provide an improved insulation for a walking beam furnace which improves the energy efficiency of the furnace.

BRIEF DESCRIPTION OF THE DRAWINGS

These and other objects and advantages of the present invention are hereinafter set forth and described with reference to the drawings wherein.

DESCRIPTION OF THE PREFERRED EMBODIMENT

Figure 1:
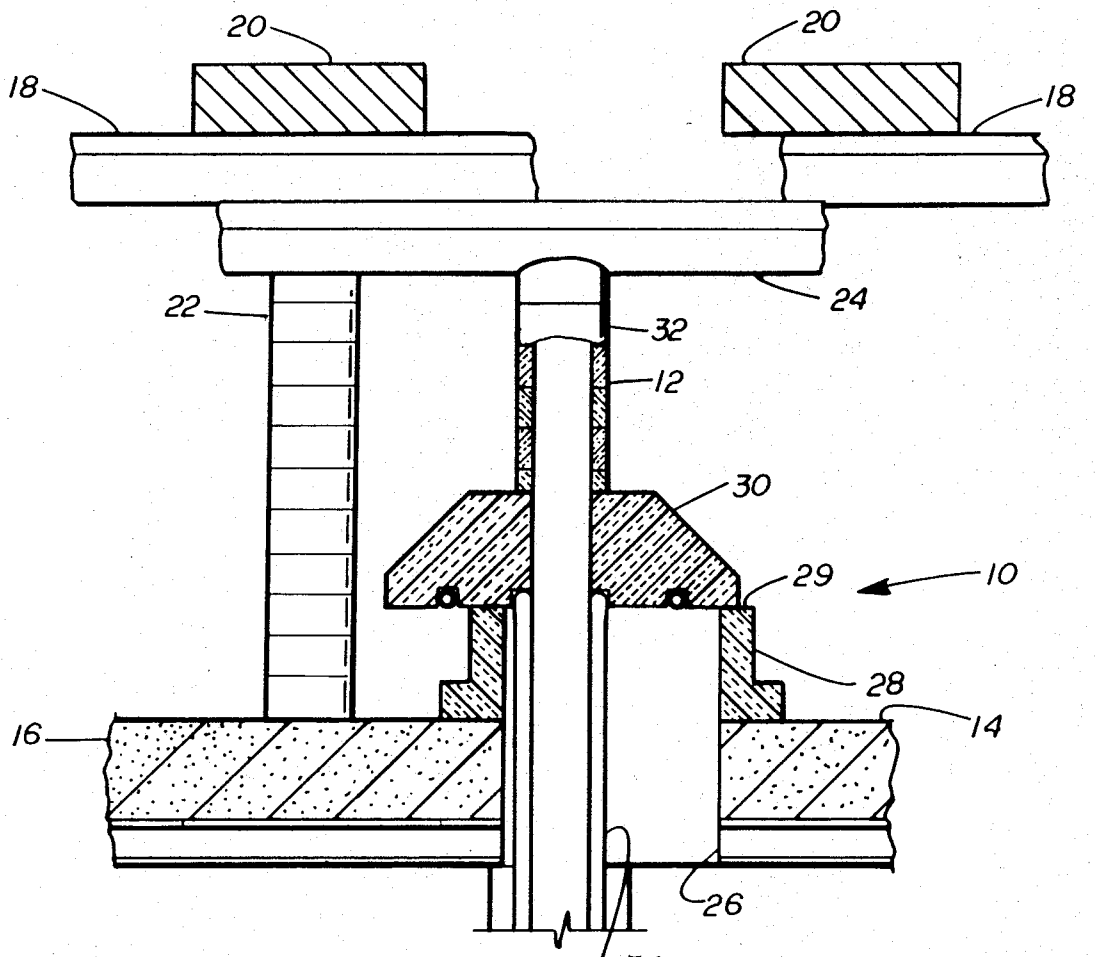
FIG. 1 is a partial sectional view through a walking beam furnace showing one of the walking legs and the work piece in section.
Figure 2:
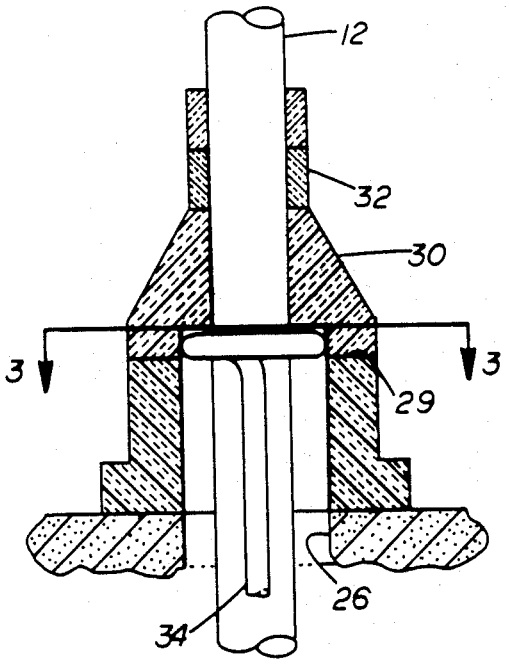
FIG. 2 is a partial sectional view of the leg of the walking beam to illustrate the relationship between the water cooling pipe and the insulation around the leg and the floor insulation around the opening.

Improved walking beam furnace insulation 10 is shown in FIG. 1 surrounding leg 12 which extends through the floor or lower surface 14 of walking beam furnace 16. A plurality of support beams 18 are positioned at the desired level in furnace 16 and extend along a substantial portion of the length of furnace 16 to support work piece 20 in its movement through the furnace. A plurality of support legs 22 extend upwardly from floor 14 to support beams 18 in their desired position. Legs 12 support and move walking beams 24 which are positioned parallel to support beams 18 and in a normal position which is below the level of support beams 18 so that they are out of engagement with work piece 20 and do not interfere with the heating of the work pieces 20 in the furnace.

Figure 3:
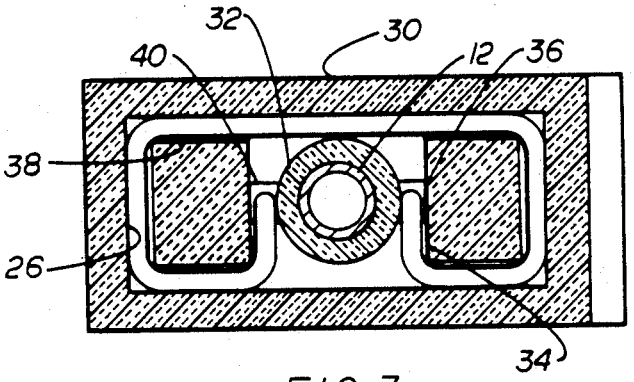
FIG. 3 is a horizontal sectional view of the walking leg taken along line 3—3 in FIG. 2.

Opening 26 through floor 14 through which leg 12 extends is oblong in shape as best seen from FIG. 3. Insulation wall 28 is constructed on the interior of floor 14 immediately surrounding each of opening 16. Wall 28 is of suitable insulating material and provides a level upper surface 29. In operation cap 30 is in close spaced relationship to upper surface 29 when leg 12 is in its lowered position. This close spaced relationship is to prevent abrasive wear of cap 30 and insulation surface 29 caused by relative movement of the two surfaces. This distance is set to provide the minimum gap which just barely allows movement without abrasion. Leg 12 connects to a suitable mechanism (not shown) below floor 14 for its movement. Insulation material 32 is located around the upper ends of legs 12 and cap 30 of suitable insulation material is positioned around each of legs 12 at a position so that with legs 12 in their position of rest the lower surface of each cap 30 is in engagement with the upper surface 29 of its insulation wall 28 as shown. Additionally, pipe 34 extends along the exterior of leg 12 to support bracket 36 which is suitably secured to leg 12 as by welding and is formed into loop 38 within cap 30 and returns through support bracket 40 secured to leg 12 on the opposite side of leg 12 from bracket 36 and pipe 34 extends from bracket 40 back to a position below floor 14 so that water or other suitable fluid may be circulated therethrough for cooling of cap 30 and leg 12 and recovery of heat loss thereto.

Figure 4A:
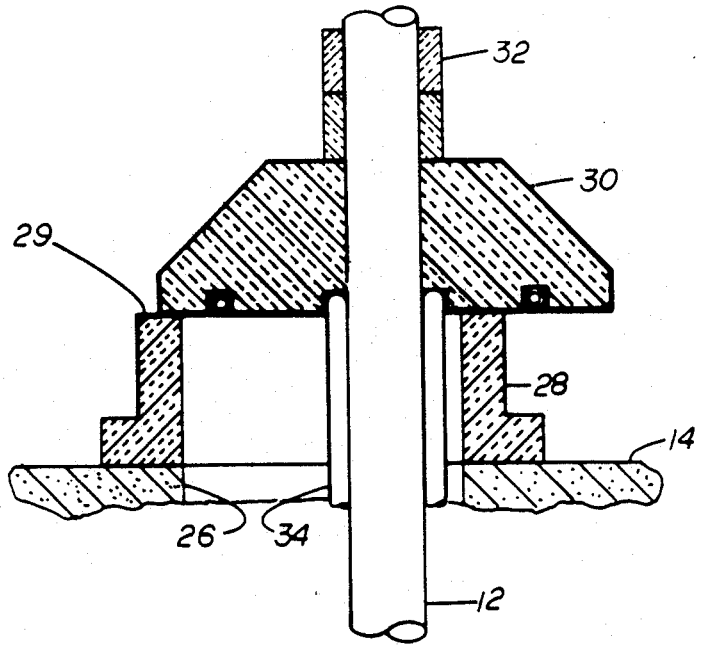
FIG. 4A is a sectional view illustrating the movement of the walking leg to its position of rest.
Figure 4B:
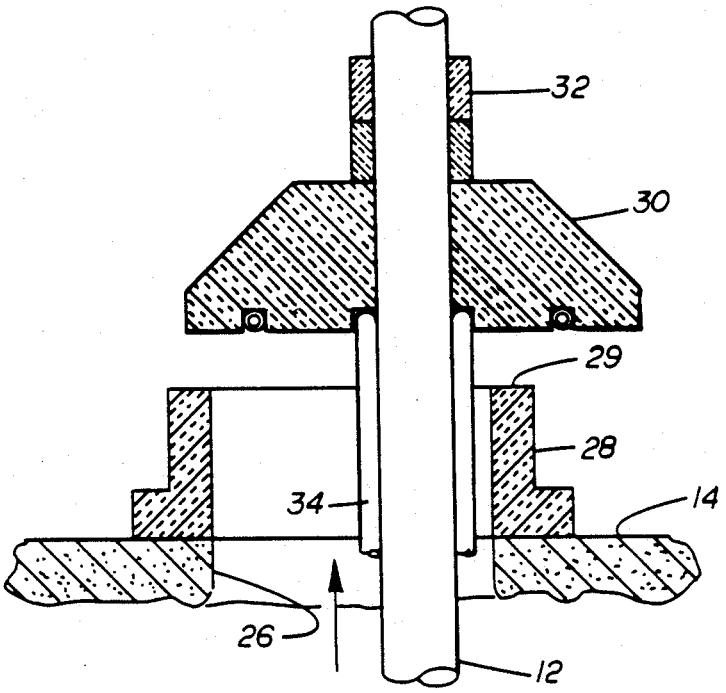
FIG. 4B is another sectional view illustrating the upward movement of the walking leg into the furnace.
Figure 4C:
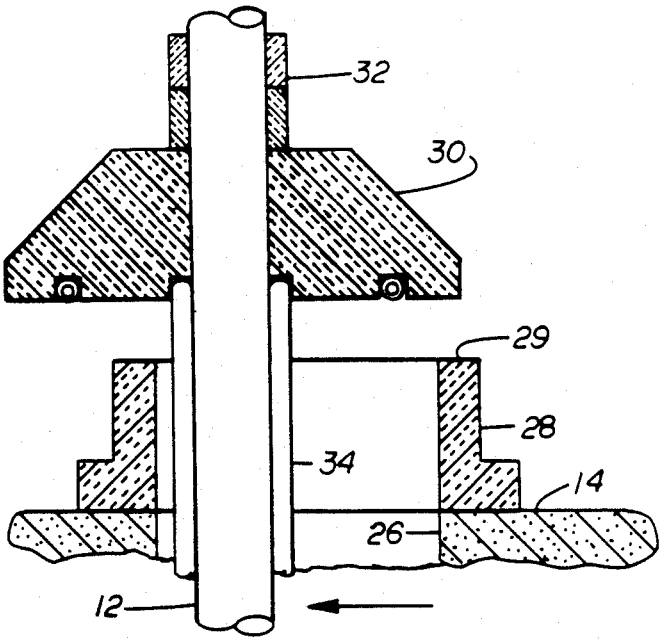
FIG. 4C is another sectional view illustrating the movement of the walking leg during the movement of the work piece.
Figure 4D:
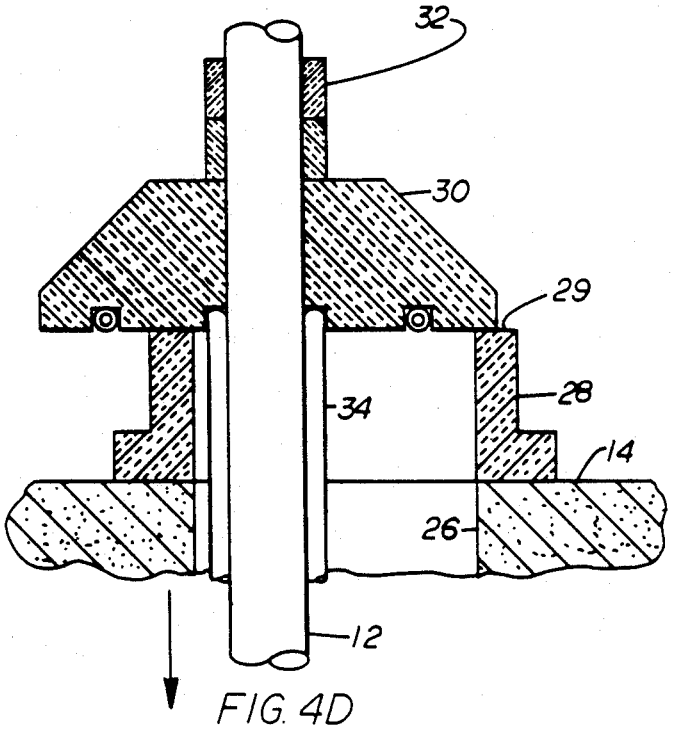
FIG. 4D is another sectional view illustrating the downward movement of the walking leg to allow the work piece to come to rest on the furnace support rails.

FIGS. 4A, 4B, 4C and 4D illustrate the four extreme positions of movement of leg 12 in its cycle or movement which includes the following: Starting from the position of rest illustrated in FIG. 4A, the initial movement of leg 12 is upward into furnace as illustrated by the arrow to the position shown in FIG. 4B in which position walking beam 24 has engaged work piece 20 and raised it above the upper level of support beams 18. Next, leg 12 moves in the direction toward the exit of furnace 16 as shown in FIG. 4C so that work piece 20 is advanced in this direction. At the end of the movement of work piece 20, leg 12 is retracted downward as shown in FIGURE 4D to a position at which work piece 20 has been lowered into engagement with support beam 18 and walking beam 24 is disengaged therefrom. Thereafter, leg 12 is returned to its position of rest shown in FIG. 4A. A typical cycle of movement of leg 12 takes approximately one-half minute and leg 12 remains in its position of rest for approximately five and one-half minutes providing movement of work piece 20 once every six minutes. It is noted from FIGS. 4B and 4C that during the time leg 12 is elevated and moving work piece 20 that cap 32 is out of engagement with the upper surface of wall 28.

It is estimated that the energy savings in a 250 ton/-hour furnace utilizing a recuperative combustion system; operating at a combustion efficiency of 60%; and having an effective heating rate of 2.0 MM BTU/ton, would amount to over $500,000 per year and the investment payback on the additional cost for the installation of the improved walking beam leg insulation and cap would be approximately 2.5 months.

What is claimed is:

1. A walking beam furnace insulation for each of the walking legs and openings in a floor of a walking beam furnace comprising an insulating cap secured closely around the intermediate exterior of each of the walking legs, and an insulating surface on the interior of the furnace surrounding each of the openings through the furnace floor through which the legs extend, said openings and said insulating surface being only sufficiently large to immediately surround only said legs and to allow for movement of said legs, said caps being positioned on said legs to be in close space relationship immediately above said surface surrounding said openings at all time except when the legs are extended upwardly into the furnace for the movement of a work piece therein to limit flow through the openings and thereby to minimize the heat loss through the floor openings.

2. A walking beam furnace insulation according to claim 1 including a pipe supported by each of said legs and formed to have a loop on the interior of the leg cap, each end of said pipe being positioned below the furnace floor, and means connecting to said pipe for circulation of water therethrough.

3. A walking beam furnace insulation according to claim 2 including brackets secured to said legs for supporting said pipes in their desired position with respect to their legs.

4. A walking beam furnace insulation according to claim 1 wherein said surface surrounding said opening includes insulation material surrounding each of said openings in the form of walls surrounding said openings on the interior of the furnace floor.

5. A walking beam furnace insulation according to claim 1 including insulation surrounding the portion of said legs extending above their caps.

6. A walking beam furnace insulation for a walking leg and an opening in the furnace floor comprising an insulating cap secured closely around a portion of the walking leg which is within the furnace, and an insulating surface facing upwardly immediately surrounding the opening through the furnace floor through which the leg extends, said opening and said insulating surface being only sufficiently large to immediately surround only said legs and to allow for movement of said legs, said cap being positioned on said leg to engage said surface at all times except when the leg is extended upwardly into the furnace for the movement of a work piece therein to limit flow therethrough to minimize the heat loss through the floor opening.

* * * * *